United States Patent [19]

Amos

[11] Patent Number: 4,518,107

[45] Date of Patent: May 21, 1985

[54] CARRIER SYSTEM FOR SKI EQUIPMENT

[75] Inventor: Jacquelyn V. Amos, Vail, Colo.

[73] Assignee: Ski Pack International, Inc., Boca Raton, Fla.

[21] Appl. No.: 506,524

[22] Filed: Jun. 22, 1983

[51] Int. Cl.[3] ..... A45F 3/04

[52] U.S. Cl. ..... 224/215; 224/224; 224/258; 224/259; 224/901; 224/917

[58] Field of Search ..... 224/209–216, 224/917, 901, 224, 258, 259; 383/4; 280/814; 294/147

[56] References Cited

U.S. PATENT DOCUMENTS

| | | | |
|---|---|---|---|
| 1,606,107 | 11/1926 | Simms | 383/4 |
| 3,731,348 | 5/1975 | Luehne | 224/901 X |
| 3,968,911 | 7/1976 | Haas | 224/158 |
| 4,308,982 | 1/1982 | Hall | 224/917 X |
| 4,332,379 | 6/1982 | Bannister | 224/215 X |

FOREIGN PATENT DOCUMENTS

| | | | |
|---|---|---|---|
| 138982 | 5/1934 | Austria | 224/153 |
| 2214104 | 9/1973 | Fed. Rep. of Germany | 224/917 |
| 816256 | 8/1937 | France | 224/917 |
| 11757 | 9/1924 | Netherlands | 224/209 |
| 331720 | 7/1958 | Switzerland | 224/917 |

*Primary Examiner*—Allan N. Shoap
*Attorney, Agent, or Firm*—Donald W. Margolis

[57] ABSTRACT

A light weight carrier system primarily for use in carrying skis and/or poles on the user's back between the shoulders. The carrier system 2 includes a plaint back body portion 4 including a top holding strap 6 and a bottom holding strap 8, each with a closure means. A pair of shoulder harness straps 14 and 16 are each attached to opposite side edges of body portion 4. In use, carrier 2 is placed horizontally and open on a substantially flat surface with straps 6 and 8 on top and accessible. A pair of skis 32, having toe binding 34 and heel binding 36, and and/or a pair of ski poles 38, are then placed on reinforcing strip 26 of body portion 4 between straps 6 and 8 with, for example, toe portion 34 of the binding above strap 6 and heel portion 36 ofthe binding above strap 8. Straps 6 and 8 are then secured tightly around the skis and/or poles and the entire carrier system lifted and placed on the user's back and between the shoulders, preferably at an oblique vertical, angle by means of harness straps 14 and 16. In preferred embodiments the ski carrier system is convertible to a waist belt when it is not being used as a carrier. In one preferred embodiment a belted pack 42 is combined with carrier 2 into which pack the carrier may be placed when not being used as a carrier.

10 Claims, 5 Drawing Figures

CARRIER SYSTEM FOR SKI EQUIPMENT

BACKGROUND OF THE INVENTION

1. Field of the Invention

The present invention relates to article carriers in which the carrier is held by two flaccid attaching means looped over different shoulders and having flaccid strap-type holding means extending across the article being held. More particularly, the invention relates to a ski equipment carrier system, and more specifically, to such a system which is flexible, lightweight, and which is adapted to carry ski equipment centered on the user's back between the shoulders.

2. Discussion of the Prior Art

Carrying skis and other ski equipment can be a problem for an individual who goes snow skiing. This is true at all times, but it is especially true at the end of a day of skiing when a combination of skier fatigue and icy or wet conditions may make the skier's movement difficult and/or awkward. Usually at least four pieces of equipment must be carried, that is two poles and two skis, and these are usually carried in heavily gloved or mittened hands. Skis, even under the best of conditions, are awkward to carry. They are, for example, normally at least as long as the user is tall, and usually longer, for example from about five to about six and three-quarter feet (about 152 to about 210 cm.) in length; and weigh, with bindings, perhaps about five to about eight pounds (about 2.3 kg. to about 3.6 kg.). Dimensionally they are too narrow and smooth to be easily grasped at their edges, and two wide to be easily held across their width. Their weight and length relationship results in substantial torque when the skis are being carried. Any unbalance in, or force applied to the skis is greatly multiplied to cause them to tend to twist or rotate quite readily, and with great force, thus tending to break the skier's grip on them or to throw the skier off balance. It would be useless to mount a holder at the center of the skis, as when they are in use this is where the skier's foot is placed.

Ski poles are also usually long, about three to about four and one-half feet in length (about 90 to about 140 cm.), but are quite light. In addition ski poles are round, and of small diameter for almost their entire length, but terminate at their bottom end in a round basket which is relatively wider in diameter than the shaft of the pole. The combination of a pole or poles with a ski or skis in the user's hand or hands causes not only a wider load, which is more difficult to grip than the skis by themselves, but also results in rolling and twisting of the poles on the skis due to the uneven contact between the skis and the poles at the wide round basket of the poles.

For the foregoing reasons it is extremely difficult to carry one ski and one pole in each hand, both skis (with or without poles) in one hand, or two skis and two poles either across both arms or under one arm for any substantial length of time or for any substantial distance. As a result, most skiers are forced to place various combinations of skis and poles over one or both of their shoulders. This still results in substantial torque, plus an added weight at a high point of the user's body which may cause loss of balance or awkwardness, especially on snow, ice or mud. This awkwardness is then further aggravated by the fact that the user is normally in heavy, stiff ski boots, and is unable to easily use his/her hands for maintaining balance or for any other purpose.

Various ski equipment carriers have been developed or disclosed in the past. Windheim U.S. Pat. No. 2,118,875 (1938) discloses a ski carrying bag having a single sling, the sling being attached at one end to a bag and at the other end to a strap secured around the skis after they have been placed in the bag. In use the skis in the carrier bag are carried by one strap over only one shoulder. Altorfer U.S. Pat. No. 2,224,568 (1940) discloses a bag for carrying demountable (break apart) skis and accessories over only one shoulder. It has a horizontal strap around the carrying person to prevent dangling of the carrier. The system is convertible to a two strap backpack when not carrying skis, but does not suggest the backpack mode for carrying skis. Helmert U.S. Pat. No. 2,530,695 (1950) discloses a combination ski carrier and waist belt including a central strap and a pair of pivotal end buckle straps. When in use as a ski carrier the buckle straps are formed into loops around the skis and the central strap is carried over only one shoulder. Hogenson U.S. Pat. Nos. 3,841,542 (1974) and 3,920,166 (1975) both disclose a single strap convertible from a waist belt to a ski carrier including a slide adjustment which allows the strap to be formed into a large loop to be placed over only one shoulder, and a single small loop to hold skis. Hall U.S. Pat. No. 4,308,982 (1982) shows a single strap connected to a rigid carrier board for skis and poles. In use the single strap of the carrier is placed on the back over only one shoulder. The disposition of the rigid carrier board while the user is skiing is not disclosed.

It is thus seen that the known prior art, references disclose ski holders which include systems for carrying skis in a sling or strap arrangement over only one shoulder. None teaches a two shoulder strap ski equipment carrying arrangement which is soft, flexible, lightweight or convertible to a belt or pack. With the exception of the Hall reference, none of these known prior art devices provides a light weight system for carrying skis centered on the user's back, where the muscles are the strongest, and in a manner which allows both of the skier's hands to be free for use and for maintaining balance.

SUMMARY OF THE INVENTION

The carrier of the present invention provides a system for use in carrying skis and/or poles or other elongated articles on the user's back, between the shoulders. The carrier includes a pliant back body member including at least two holding straps for the skis and/or poles, each with a closure to allow them to be secured around the skis and/or poles. A pair of flexible harness or sling straps to be looped over different shoulders are also attached to the pliant body member. In preferred embodiments a waist belt is attached to the body member.

In use, the carrier system of the present invention is preferably placed horizontally upon, a flat surface with its holding straps on top and accessible. A pair of skis and/or ski poles is then placed on the body member with, for example, when skis are being carried, the skis' bindings where they will be above a holding strap when the carrier is lifted and placed on the user's back. The holding straps are then secured around the ski equipment and the entire carrier lifted and placed on the user's back and both shoulders by means of a harness strap looped over each of the user's shoulders. When the carrier system includes a waist belt, the belt is then secured around the user's waist to limit swaying of the carrier and equipment while the user is walking. The skis equipment is then carried on the user's back between the user's shoulders, preferably in a substantially oblique vertical position so that the top of the carried equipment will not contact the user's head and the bottom of the equipment will not contact the user's legs. In preferred embodiments the shoulder harness straps and waist belt are provided with means to adjust their fit to the user. The ski equipment carrier system of the present invention is convertible to a waist belt when it is not being used as a ski equipment carrier, for example when the user is skiing. In one preferred embodiment a belted pack is combined with the carrier system of the present invention, into which pack the carrier can be the present invention, to which pack the carrier can be canconveniently placed when it is not being used as a ski equipment carrier.

It is accordingly an object of the present invention to provide a new and improved soft, flexible, light weight, two shoulder strap carrier system with the aid of which skis or other elongated equipment can be held on a user's back, between the user's shoulders where the muscles are the strongest, and in a manner which allows both of the user's hands to be free for use and to maintain balance.

These and other objects of the present invention will become apparent to those skilled in the art from the following detailed description, showing the novel construction, combination, and arrangement of parts as herein described, and more particularly defined by the appended claims, it being understood that such changes in the precise embodiments of the herein disclosed invention are meant to be included as come within the scope of the claims except insofar as precluded by the prior art.

BRIEF DESCRIPTION OF THE DRAWINGS

The accompanying drawings illustrate complete preferred embodiments of the present invention according to the best mode presently devised for the practical application of the principles thereof, and in which.

DETAILED DESCRIPTION OF THE INVENTION

Figure 1:
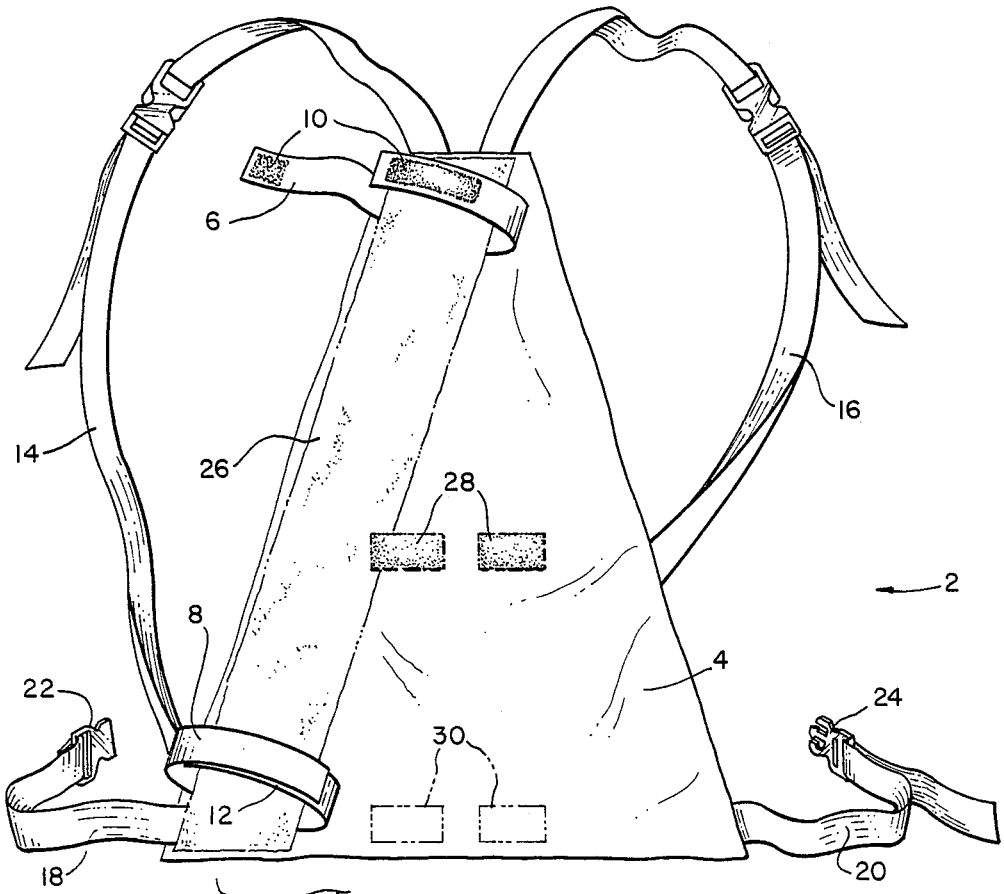
FIG. 1 is a front perspective view of a ski equipment carrier system embodying the present invention.
Figure 2:
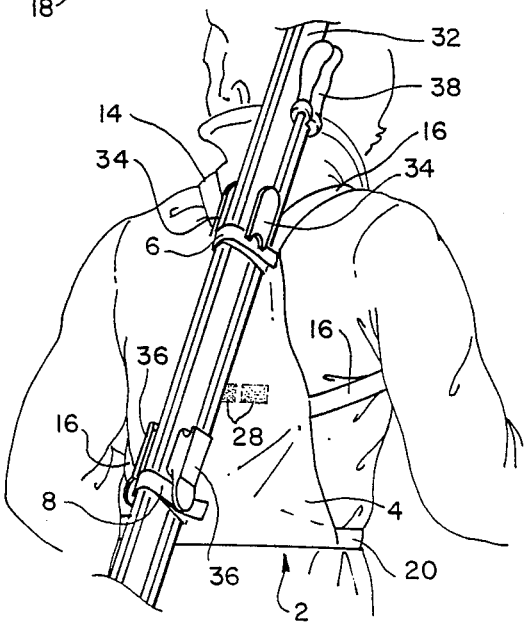
FIG. 2 is a pictorial view showing a user carrying a pair of skis and a pair of ski poles in an oblique vertical position on the user's back and between the user's shoulders by means of the carrier system of FIG. 1.
Figure 3:
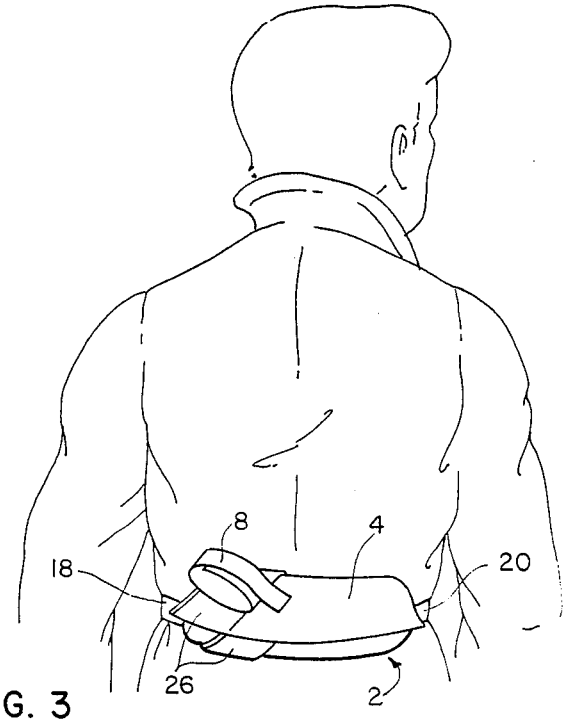
FIG. 3 is a pictorial view showing a user carrying the carrier system of FIG. 1 around the user's waist in the form of a belt.

Referring now to FIGS. 1 and 2 in detail, reference character 2 is used to designate generally the carrying system of the present invention. The carrier system 2 includes a trapezoidal pliant back body member including a top holdingstrap 6, shown open, and a bottom holding strap 8, shown closed, each with closure means 10 and 12, respectively, such as Velcro. A pair of adjustable shoulder harness straps 14 and 16 are each attached at one of their ends at substantially the top of body member 4, with the second end of strap 14 secured at a portion of the body member 4 substantially adjacent to lowest holding strap 8, while the second end of strap 16 is secured intermediate the other side of body member 4. In preferred embodiments front closure waist belts 18 and 20, terminating in closures 22 and 24, respectively, are attached at opposite sides substantially at the bottom of body member 4, and bottom member 4 also includes reinforcing strip 26 running obliquely along the left edge of body member 4 substantially continuously intermediate holding straps 6 and 8. Reinforcing strip 26 not only provides strength and durability to the carrier, but also protects the user and the user's clothing from potential damage due to sharp ski edges, dirt, and moisture. In the embodiment shown in FIGS. 1–3, roll closures 28 and 30 (shown in phantom) are located on opposed surfaces of body member 4 for use in holding carrier system 2 in a folded structure, as shown in FIG. 3 and detailed below. The entire system weighs less than 8 oz. (0.23 kg.).

In use, carrier 2 is normally placed horizontally and open on a substantially flat surface with straps 6 and 8 on top, open and accessible. A pair of skis 32, having toe binding 34 and heel binding 36, and/or a pair of ski poles 38, are then placed on reinforcing strip 26 of body member 4 between open straps 6 and 8 with, for example, toe portion 34 of the binding above strap 6 and heel portion 36 of the binding above strap 8. Straps 6 and 8 are then secured tightly by means of closures 10 and 12, respectively, around skis 32 and/or poles 38 and the entire carrier system 2, with skis 32 and/or poles 38 secured thereto, lifted and placed on the user's back with the ski equipment in a substantially oblique vertical position and held in place at both shoulders by means of harness straps 14 and 16, as shown in FIG. 2. Front closure waist belts 18 and 20 are then secured around the user's waist by means of closures 22 and 24. Shoulder harness straps 14 and 16 and belts 18 and 20 are then adjusted as required by the user.

Ski carrier system 2 is convertible to a waist belt, when it is not being used as a ski equipment carrier, by the steps of removing it from the back and shoulders, removing the items being carried by closure straps 6 and 8, gathering shoulder straps 14 and 16 along the surface of body member 4 which is opposed to straps 6 and 8, folding or rolling body portion 4 from the top completely to the bottom, while keeping straps 6 and 8 within the folded portion. When thus folded, closures 28 and 30, are brought into registration with one another and secured together to keep the rolled carrier system in a tightly closed configuration, suitable for being carried around the user's waist as an ornamental belt or garment by means of belts 18 and 20, all as shown in pictorial detail in FIG. 3.

Figure 4:
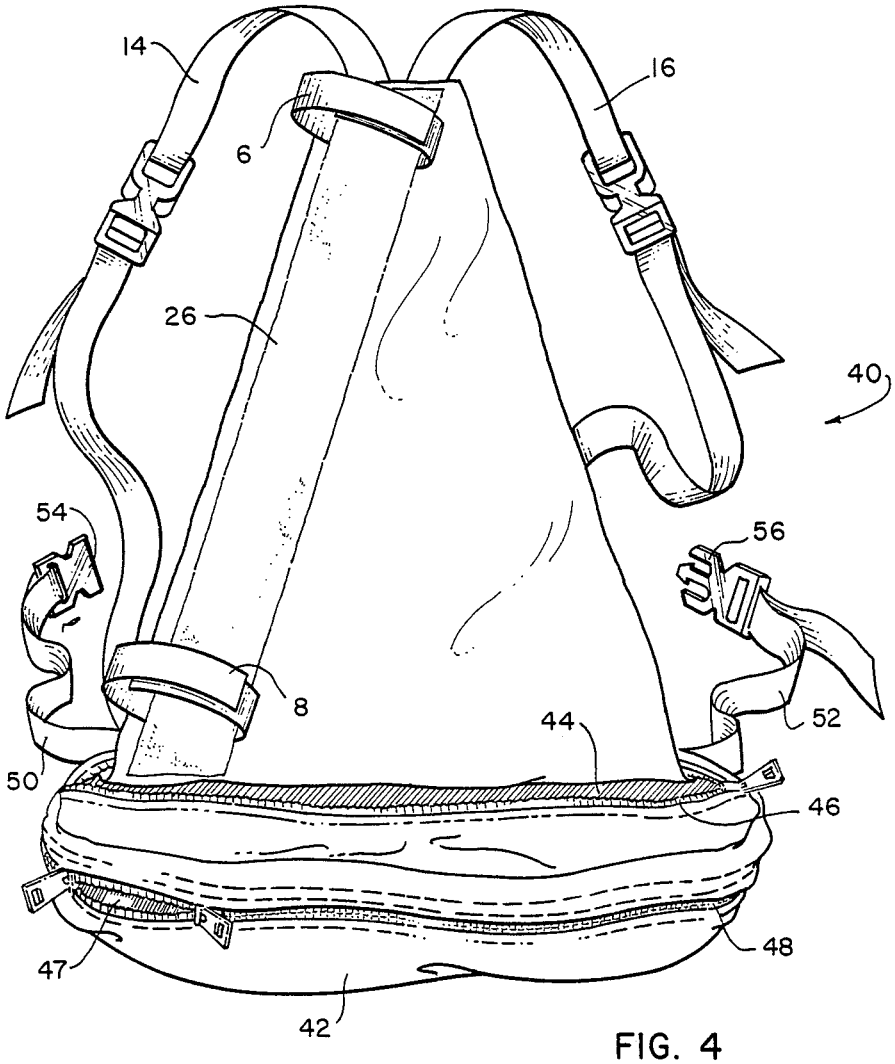
FIG. 4 is a front perspective view of a modified form of a ski equipment carrier system of the present invention in which a belted pack is combined with the carrier system.
Figure 5:
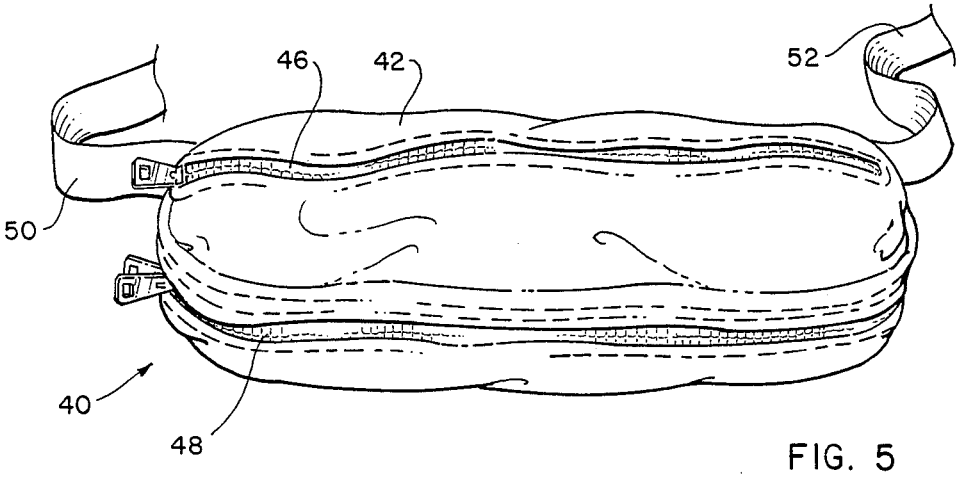
FIG. 5 is a perspective view of the modified carrier system of FIG. 4 in which the carrier system has been placed in the pack.

Referring now to FIGS. 4 and 5, one modified form of the present invention, generally 40, is set forth in detail. In this embodiment like numbers represent like parts in FIGS. 4 and 5 as those same numbers represent in FIGS. 1–3. In the embodiment of FIGS. 4 and 5, a pack 42 is combined with the bottom of body member 4 of the ski equipment carrier. Pack 42 includes at least one closable compartment 44. The bottom of ski equipment carrier body member 4 is secured within compartment 44 by any state of the art securing technique, to form a combined portion of the inner back surface of compartment 44. Compartment 44 is closable by, for example, zipper system 46, or by other closure means upon collapsing the body member. In the embodiment shown, pack 42 includes a second compartment 47 closable by means of dual zipper system 48. Second compartment 47 is functional for carrying items such as ski goggles, snacks, suntan lotion, bandanas, gloves, and hats in a secure, convenient multi-functional carrier. In this embodiment, closure belts 50 and 52, terminating in closures 54 and 56, respectively, are attached to opposite sides of pack 42. The entire system weighs less than 1 lb. (0.45 kg.).

When ready for use as a ski equipment carrier, this embodiment is configured as shown in FIG. 4, with zipper 46 open and body member 4 and its associated straps external to compartment 44. Ski equipment is secured to system 40 and carried in substantially the same manner as described with regard to system 2.

Modified system 40 is convertible to an enclosed belted fanny pack when it is not in use as an equipment carrier by the steps of removing the elongated items being carried, and gathering or folding body portion 4 and shoulder straps 14 and 16 within compartment 44, and then closing compartment 44 by means of zipper system 46 to the closed configuration shown in FIG. 5. When so configured, system 40 is suitable for being carried around the user's waist as a fanny pack by means of belts 50 and 52, all as shown pictorially in detail in FIG. 5.

As can be seen from the foregoing description of preferred embodiments, the present invention provides a new and improved soft, flexible, light weight, two shoulder strap carrier system with the aid of which skis or other elongated equipment can be held on a user's back between the shoulders in a manner which allows both of the user's hands to be free for use and to maintain balance.

While certain preferred embodiments and details have been shown, other modifications are within the scope of the invention. As will be apparent to one skilled in the art certain modifications in the system shown may be readily made. For example, in preferred embodiments the pliant body portion and pack are nylon; however the use of rip-stop nylon, canvas, or other lightweight flexible cloth or plastic material is contemplated. Leather is the material of choice for reinforcing strip 26, but other material may be used. Similarly as to the shoulder harnesses and belts, woven nylon webbing is the preferrred material of choice, but other durable webbing or strap material may be used. Art known means for adjusting the shoulder straps and closing and adjusting the waist belts is as shown, but other means may be used as a matter of choice from among many art known devices. Ski equipment closure straps 6 and 8 may be closed using other adjustable mechanisms and closures in place of Velcro. Similarly, snaps or tabs or other closure devices, may be readily substituted for Velcro closures 28 and 30 and zippers 46 and 48 and still be within the scope of the present invention. While body member 4 is shown in the form of a trapezoid, for the efficient use of material, other shapes may also be used. In a like manner, while it is preferred to have the article holding straps located in a manner such that the articles held are in an oblique vertical position, to keep the top of the skis from hitting the back of the user's head and the bottom of the skis from hitting the back of the user's legs, other oblique angles, and even vertical and horizontal positions while not preferred, are contemplated within the practice of the present invention.

It is therefore apparent that while the invention has been particularly shown and described with reference to preferred embodiments thereof, it will be understood by those skilled in the art that the foregoing and other modifications or changes in form and details may be made therein without departing from the spirit and scope of the invention as claimed, except as precluded by the prior art.

What is claimed is:

1. A carrier system for elongated ski equipment designed to permit a user to carry said carrier system and any elongated ski equipment held thereto on the back between the shoulders, while leaving the arms and hands free, said system being convertible from a carrier to a waist belt and vice versa, comprising, in combination:

a flexible, substantially trapezoidal body member having a first substantially flat side, a first side edge, a second side edge, and a bottom edge, wherein at least one of said side edges is at an angle oblique to the body of a user when said carrier system is carried on a user's back between the shoulders, and an opposed second side, said first side being adapted to rest against a user's back substantially between the shoulders;

at least two spaced apart holding straps, each holding strap including, in combination, a releasable closure system wherein the two most widely spaced apart straps define a substantially straight path between them, said holding straps located and adapted to releasably hold elongated equipment on said second side of said body member, and wherein said straight path defined by said holding straps is substantially parallel to said oblique edge, and wherein there is a reinforcing strip secured to said second side of said body member along a substantial portion of said straight path defined by said most widely spaced apart holding straps;

a pair of adjustable harness straps attached to said body member so as to enable said body member to be carried on the back over both shoulders of a user; and an adjustable belt system connected to said body member and adapted to be secured around the waist of a user by releasable closure means in combination with said belt system, said belt system including a first portion and a second portion, said first belt portion extending from said first side edge of said body member, and said second belt portion extending from said second side edge of said body member;

whereby, a user is permitted to carry the carrier system and any elongated ski equipment held thereto by said holding straps on the back, between the shoulders, and, with said belt system, limit movement of said carrier system and any elongated ski equipment held thereto when said system is being used as a carrier, said belt system being further adapted, when said body member is converted to a smaller folded structure, to provide a waist belt by which said folded structure may be secured around the waist of a user, both modes leaving the arms and hands of the user free.

2. The carrier system of claim 1 wherein a pack including a closable compartment is connected in combination with said body member, said bottom edge of said body member being connected to said pack within said closable pack compartment.

3. The carrier system of claim 1 wherein said first and second belt portions include, in combination, a releasable closure system.

4. The carrier system of claim 1 wherein said body member is substantially trapezoidal in shape.

5. The carrier system of claim 1 wherein said harness strap most nearly adjacent said obliquely angled edge of said body member is connected to said body member in the vicinity of each of the two most widely separated holding straps.

6. The carrier system of claim 1 wherein each harness strap is attached to one of said opposed side edges.

7. The carrier system of claim 1 wherein said body member includes means for releasably securing said body member in a smaller folded structure.

8. The carrier system of claim 7 wherein said securing means includes a first element located on said first side of said body member and a second element located on said second side of said body member, said first and second securing element means being further located such that, when said body element is folded to form a smaller structure, said first and second securing elements will be brought into substantial registration and securing contact with one another.

9. The carrier system of claim 1 wherein said body member includes a bottom edge, and wherein a pack including a closable compartment is connected in combination with said body member, said bottom edge of said body member being connected to said pack within said closable pack compartment.

10. The method of using the system of claim 1 including the steps of:

placing said first side of said carrier system horizontally upon, a substatially flat surface with said second side and said holding straps on top and accessible;

placing elongated ski equipment on said body member between said holding straps;

securing said holding straps around the ski equipment; and then lifting the entire carrier system and placing it on the user's back and both shoulders by means of said harness straps over each of the user's shoulders, so that the ski equipment is then carried on the user's back between the user's shoulders.

* * * * *